US011560865B2

(12) United States Patent
Jung

(10) Patent No.: US 11,560,865 B2
(45) Date of Patent: Jan. 24, 2023

(54) VEHICLE AIR CLEANER

(71) Applicants: Hyundai Motor Company, Seoul (KR); Kia Motors Corporation, Seoul (KR)

(72) Inventor: Jae Hyeon Jung, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 175 days.

(21) Appl. No.: 17/115,169

(22) Filed: Dec. 8, 2020

(65) Prior Publication Data

US 2021/0381475 A1 Dec. 9, 2021

(30) Foreign Application Priority Data

Jun. 4, 2020 (KR) ..... 10-2020-0067558

(51) Int. Cl.
*F02M 35/02* (2006.01)
*F02M 35/024* (2006.01)

(52) U.S. Cl.
CPC .... *F02M 35/0218* (2013.01); *F02M 35/0201* (2013.01); *F02M 35/02416* (2013.01); *F02M 35/02475* (2013.01)

(58) Field of Classification Search
CPC ..... F02M 35/0218; F02M 35/0201; F02M 35/0245; F02M 35/02475; F02M 35/02416; B01D 46/0004; F16J 15/025
See application file for complete search history.

(56) References Cited

U.S. PATENT DOCUMENTS 2,936,853 A * 5/1960 Heller ..... F02M 35/024 55/419
7,163,574 B2 * 1/2007 Bause ..... F02M 35/1255 55/385.3
10,035,093 B2 * 7/2018 Worrall ..... B01D 46/521
2007/0227108 A1 * 10/2007 Ishida ..... B01D 53/0415 55/521
2010/0154369 A1 * 6/2010 Berisha ..... B01D 46/103 55/503
2013/0152528 A1 * 6/2013 Disson ..... B01D 46/4236 55/480
2014/0305308 A1 * 10/2014 Dirnberger ..... B01D 53/04 96/136
2018/0171948 A1 * 6/2018 McClelland ..... B01D 53/0446
2020/0129912 A1 * 4/2020 Williams ..... B01D 53/0407
2021/0010447 A1 * 1/2021 Thompson ..... F02M 35/02416

FOREIGN PATENT DOCUMENTS

DE 3518076 A * 11/1985 ..... B01D 46/103

* cited by examiner

*Primary Examiner* — Grant Moubry
(74) *Attorney, Agent, or Firm* — Fox Rothschild LLP

(57) ABSTRACT

A vehicle air cleaner is configured to improve the capability of a hydrocarbon trap mounted in a case to collect hydrocarbons. The vehicle air cleaner includes a case having an inlet port, through which external air is introduced, and an outlet port, through which filtered air is discharged, a filter assembly provided in a first space of an internal space in the case to filter the external air introduced through the inlet port and to remove foreign substances from the external air, and a hydrocarbon trap provided in a second space of the internal space in the case, through which the air filtered through the filter assembly flows, to collect hydrocarbons in the second space.

16 Claims, 11 Drawing Sheets

VEHICLE AIR CLEANER

CROSS-REFERENCE TO RELATED APPLICATION

This application claims under 35 U.S.C. § 119(a) the benefit of Korean Patent Application No. 10-2020-0067558 filed on Jun. 4, 2020, the entire contents of which are incorporated herein by reference.

BACKGROUND

(a) Technical Field

The present disclosure relates to a vehicle air cleaner, more particularly, to the vehicle air cleaner equipped with a hydrocarbon trap (HC-trap) capable of collecting hydrocarbons.

(b) Description of the Related Art

As is well known in the art, an engine of a vehicle must be provided with air in order to burn fuel, and the air required to burn fuel is supplied to the engine of the vehicle from outside of the vehicle.

However, because external air (i.e., from outside a vehicle) contains a large amount of foreign substances such as dust, the foreign substances must be removed from the air during intake of the air. To this end, it is possible to remove the foreign substances from the air by passing the air through an air cleaner before introducing the same into the engine.

Specifically, when external air from outside a vehicle is introduced into an air cleaner through an air hose, the air introduced into the air cleaner passes through a filter, thereby removing foreign substances from the air. The air having passed through the filter is transferred to an intake manifold through an air hose and is supplied to the engine.

Generally, vehicle air cleaners are classified into a vertical-flow-type air cleaner, in which air introduced into a case passes through a filter upwards or downwards, and a horizontal-flow-type air cleaner, in which air introduced into a case passes through a filter inwards or outwards.

It is known that, when gaseous hydrocarbons (HC) in harmful exhaust gas discharged from a vehicle during running or idling of the vehicle is discharged to the atmosphere, the hydrocarbon gas chemically reacts with low-level atmospheric ozone, thereby generating photochemical smog.

Hydrocarbons are harmful substances in constituents of vehicular fuel. When a vehicle is stopped and then the engine of the vehicle is turned off, the gas containing hydrocarbons in the cylinder of the engine may be transferred to the inside of an air cleaner through an intake port.

Because negative pressure of an engine does not act when an engine is turned off, hydrocarbon gas may flow to an air cleaner from a cylinder of the engine, and the hydrocarbon gas transferred to the air cleaner may be discharged to outside of the air cleaner through a filter.

Because the discharged hydrocarbon gas resides near an air intake system of the engine (an air cleaner, an air hose, a throttle body and the like), and is harmful to a human body, there is a need to remove the hydrocarbons before discharging the hydrocarbons to the outside from the air cleaner.

A typical air cleaner is constructed such that a hydrocarbon trap (HC-trap) is provided above a filter in a case so as to collect hydrocarbons, which are air pollutants, through the hydrocarbon trap.

Specifically, when hydrocarbon gas, which is discharged from a cylinder of an engine through an intake port after a vehicle is stopped and an engine is turned off, is transferred to an air cleaner through an air hose, and passes through a filter provided in a case of the air cleaner, hydrocarbons having passed through the filter are collected in a hydrocarbon trap provided above the filter.

Thereafter, when the engine is turned over and is driven again, the hydrocarbons collected in the hydrocarbon trap together with external air introduced into the air cleaner are sucked into the engine through the filter and are then burned in the cylinder.

However, because a conventional horizontal-flow-type air cleaner is constructed such that the hydrocarbon trap provided in the case of the air cleaner is positioned far from an air hose connector (that is, an outlet port of the air cleaner), through which hydrocarbon gas from the engine is introduced, it is difficult to effectively collect hydrocarbons.

The above information disclosed in this Background section is only for enhancement of understanding of the background of the disclosure and therefore it may contain information that does not form the prior art that is already known in this country to a person of ordinary skill in the art.

SUMMARY

The present disclosure provides a vehicle air cleaner capable of improving the capability of a hydrocarbon trap mounted in a case to collect hydrocarbons and of efficiently and effectively collecting hydrocarbons through the hydrocarbon trap.

In one aspect, the present disclosure provides a vehicle air cleaner including a case including an inlet port, through which external air is introduced, and an outlet port, through which filtered air is discharged, a filter assembly provided in a first space of an internal space in the case so as to filter the external air introduced through the inlet port and to remove foreign substances from the external air, and a hydrocarbon trap provided in a second space of the internal space in the case, through which the air filtered through the filter assembly flows, so as to collect hydrocarbons in the second space.

Other aspects and preferred embodiments of the disclosure are discussed infra.

BRIEF DESCRIPTION OF THE DRAWINGS

The above and other features of the present disclosure will now be described in detail with reference to certain exemplary embodiments thereof, illustrated in the accompanying drawings which are given hereinbelow by way of illustration only, and thus are not limitative of the present disclosure, and wherein.

Figure 1:
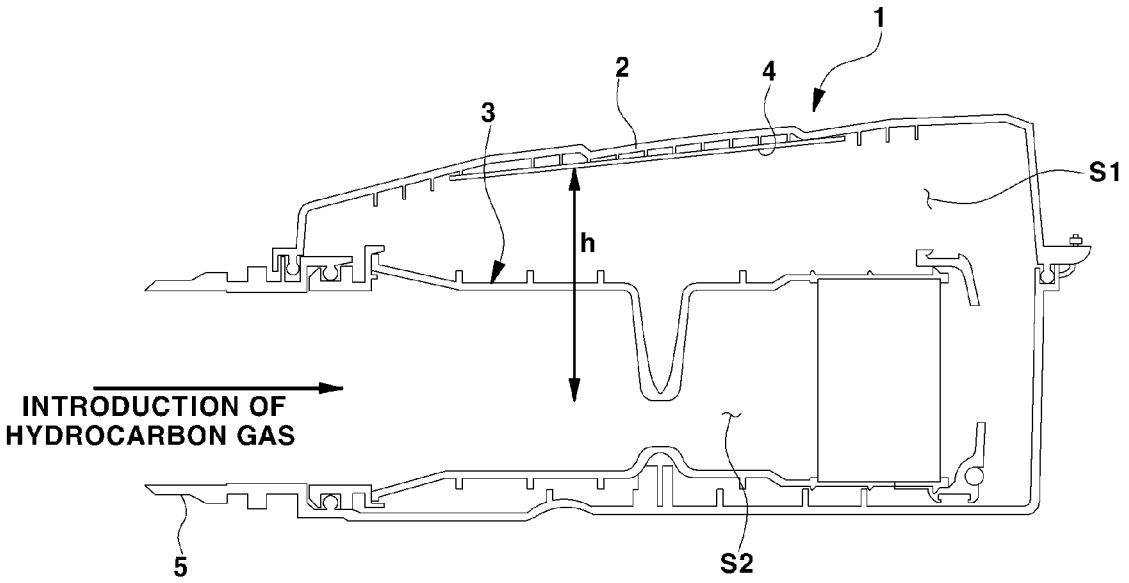
FIG. 1 (RELATED ART)
FIG. 1 (RELATED ART) is a cross-sectional view illustrating a conventional vehicle air cleaner.

It should be understood that the appended drawings are not necessarily to scale, presenting a somewhat simplified representation of various preferred features illustrative of the basic principles of the disclosure. The specific design features of the present disclosure as disclosed herein, including, for example, specific dimensions, orientations, locations, and shapes, will be determined in part by the particular intended application and use environment.

In the figures, the reference numbers refer to the same or equivalent parts of the present disclosure throughout the several figures of the drawing.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, preferred embodiments of the present disclosure will be described with reference to the attached drawings so as to enable the embodiments to be easily understood by one of ordinary skill in the art to which this disclosure belongs. However, the present disclosure is not limited to the embodiments disclosed hereinafter, but may be embodied in different modes.

The present disclosure provides a vehicle air cleaner including a hydrocarbon trap provided in a case, which is capable of improving a capability of the hydrocarbon trap to collect hydrocarbons and of efficiently and effectively collecting hydrocarbons.

In order to assist in understanding the present disclosure, problems with related art will first be further described with reference to the accompanying drawings, and then preferred embodiments of the present disclosure will be described in detail.

FIG. 1 (RELATED ART) is a cross-sectional view illustrating a conventional vehicle air cleaner.

As illustrated in FIG. 1, the conventional vehicle air cleaner 1 includes a case 2, a filter assembly 3, which is provided in the case 2 so as to filter foreign substances in the air, and a hydrocarbon trap 4, which is provided on the inner surface of the case 2 above the filter assembly 3 so as to collect hydrocarbons (HC).

Among the internal spaces in the case 2 of the air cleaner 1 shown in FIG. 1, a space S1 is a first dirty-side space through which external air introduced through an inlet port (not shown) of the case 2 flows before being filtered, and a space S2 is a second clean-side space through which the air, which has passed through the filter assembly 3 while being filtered, passes.

As shown in FIG. 1, in the conventional air cleaner 1, the hydrocarbon trap 4 is provided on the inner surface of the upper part of the case 2 in the internal space of the case 2. Hence, the height h of the hydrocarbon trap 4 above an air hose connector (an outlet port 5 of the air cleaner), which is connected to an engine (not shown) via an air hose (not shown), is increased.

When the engine is turned off after the vehicle is stopped, hydrocarbon gas, which is discharged from the cylinder (the combustion chamber) of the engine through an intake port, is reversely introduced into the case 2 of the air cleaner 1. At this time, the hydrocarbons pass through the filter assembly 3 in the case, and are then collected in the hydrocarbon trap 4, which is provided on the inner surface of the upper part of the case 2.

As illustrated in FIG. 1, because in the conventional air cleaner 1, the distance between the air hose connector 5 of the case 2 and the hydrocarbon trap 4 is increased, there is a disadvantage in terms of collection efficiency due to the tendency of hydrocarbon to sink down because the hydrocarbon gas is heavier than air.

Furthermore, because dust is easily introduced into air holes in the hydrocarbon trap, there is a disadvantage in terms of capability to collect hydrocarbons. In addition, because the hydrocarbon trap 4 is positioned in the first space S1 through which air passes before being filtered, foreign substances contained in the air may be easily introduced into the air holes in the hydrocarbon trap.

As a result, the hydrocarbon trap may be easily clogged with foreign substances in the air. When the hydrocarbon trap is clogged with foreign substances in the air, there is a problem in that the ability to collect hydrocarbons is deteriorated.

Accordingly, the present disclosure has been made in view of the above problems, and provides a vehicle air cleaner, in which a hydrocarbon trap is positioned close to an outlet port in an internal space in a case and which ensures excellent sealing properties between associated components.

Figure 2:
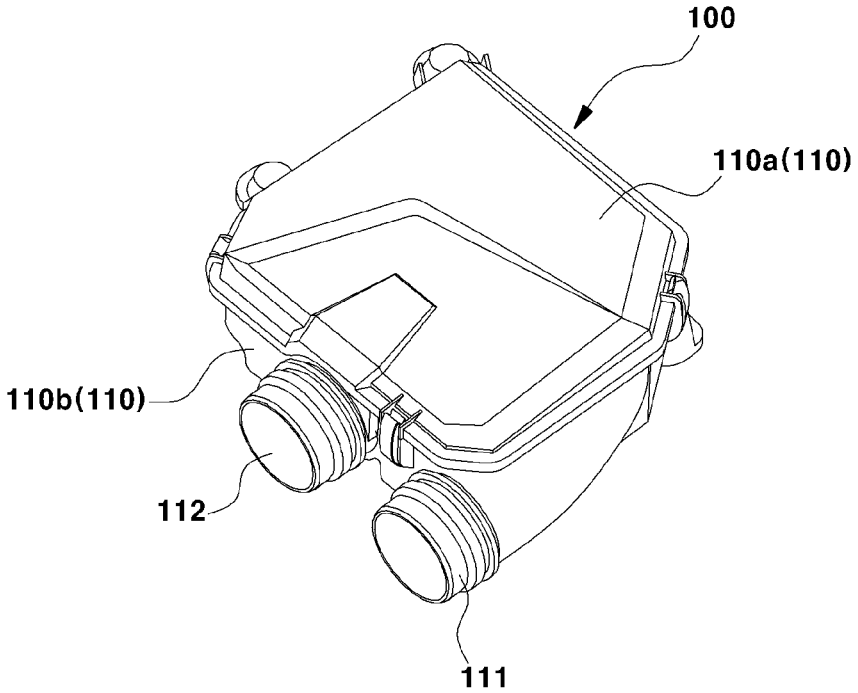
FIG. 2 is an assembled perspective view illustrating a vehicle air cleaner according to an embodiment of the present disclosure.
Figure 3:
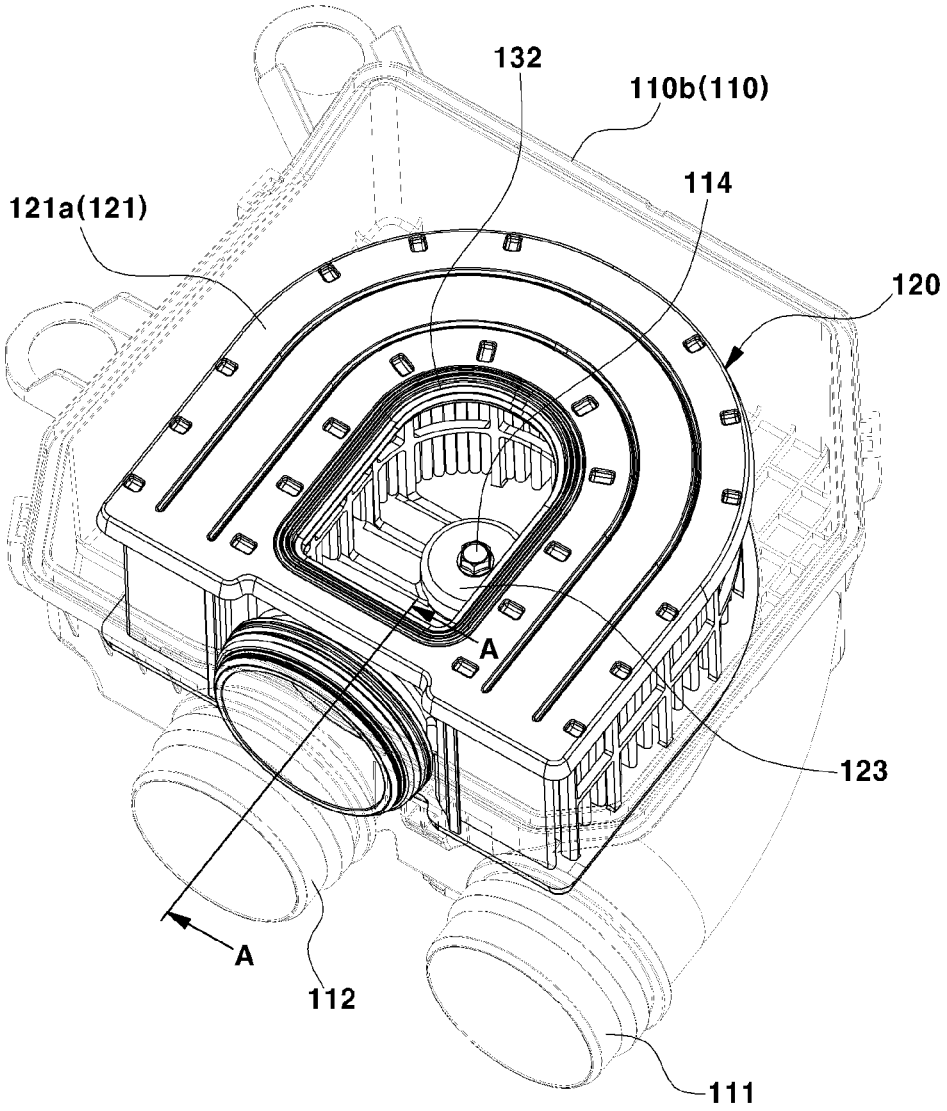
FIG. 3 is an assembled perspective view of the vehicle air cleaner according to the embodiment of the present disclosure, from which a first upper case is removed.
Figure 4:
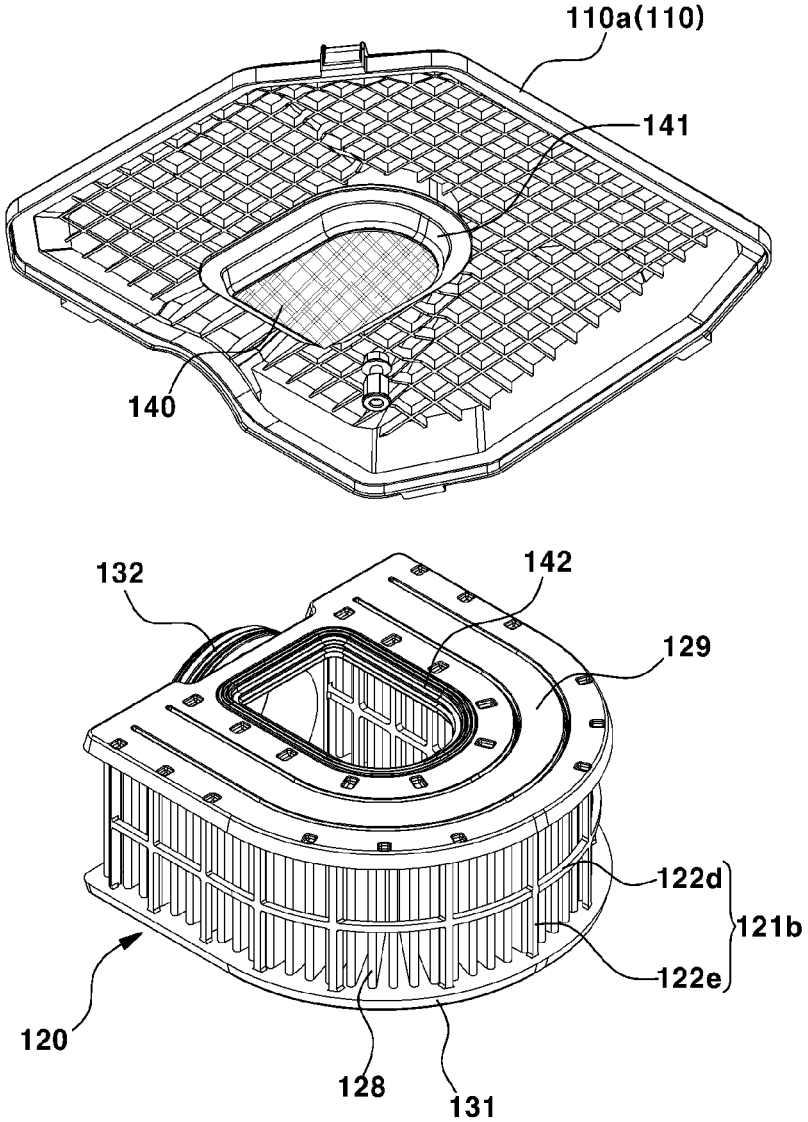
FIG. 4 is an exploded perspective view of the vehicle air cleaner according to the embodiment of the present disclosure, from which the first upper case and a filter assembly are removed.

FIG. 2 is an assembled perspective view illustrating a vehicle air cleaner according to an embodiment of the present disclosure. FIG. 3 is an assembled perspective view of the vehicle air cleaner according to the embodiment of the present disclosure, from which a first upper case is removed. FIG. 4 is an exploded perspective view of the vehicle air cleaner according to the embodiment of the present disclosure, from which the first upper case and a filter assembly are removed.

As illustrated in FIGS. 2-4, the vehicle air cleaner 100 according to the embodiment of the present disclosure, which is of a horizontal flow type, includes a case 110, which defines therein an internal space and includes an inlet port 111 and an outlet port 112, a filter assembly 120 provided in the internal space of the case 110, and a hydrocarbon trap 140, which is provided in a second space S2 through which the air filtered through the filter assembly 120 in the internal space of the case 110 flows.

The case 110 may include a first case 110*a*, which is an upper case, and a second case 110*b*, which is a lower case. The first case 110*a* is coupled to the upper end of the second case 110*b*. Consequently, a hermetical internal space is defined between the first case 110*a*, that is, the upper case, and the second case 110*b*, that is the lower case, which are coupled to each other.

Here, the filter assembly 120 and the hydrocarbon trap 140 are provided in the hermetical internal space in the air cleaner 100, specifically in the hermetical internal space defined between the first case 110*a* and the second case 110*b*, which are coupled to each other.

The inlet port 111 and the outlet port 112 may be respectively formed in a region and another region of the second case 110*b* of the case 110.

The inlet port 111 is a port, through which external air (air which is not filtered) is introduced into the case 110 of the air cleaner 100. The outlet port 112 is a port, through which the air, from which foreign substances are removed through the filter assembly 120, is discharged from the case 110 of the air cleaner 100.

In other words, the outlet port 112 is a port communicating with the second clean-side space S2 among the internal spaces in the case 110 of the air cleaner 100, and the inlet port 111 is a port communicating with the first dirty-side space S1 among the internal spaces in the case 110 of the air cleaner 100.

Since an air hose (not shown) is connected to the outlet port 112 and is connected to an intake side of an engine (not shown), the outlet port 112 serves as a hose connector for the air cleaner 100 to which the air hose connected at one end of the outlet port 112 to the engine is connected at the other end of the outlet port 112.

The outlet port 112 of the air cleaner 100 serves not only as an outlet, through which the air filtered through the filter assembly 120 is discharged from the air cleaner 100, but also as an inlet, through which hydrocarbon gas, which is discharged from the cylinder of the engine when the engine is turned off, is introduced into the air cleaner 100.

The inlet port 111 of the air cleaner 100 is connected to an additional air hose (or an air duct) (not shown), and external air is introduced into the internal space in the case 110 of the air cleaner 100.

As illustrated in FIG. 3, the filter assembly 120 is provided in the internal space in the case 110 of the air cleaner 100. The filter assembly 120 is disposed in the internal space in the case 110 of the air cleaner 100 so as to have a "U" shape.

In other words, the filter assembly 120 is manufactured and assembled so as to have an approximate "U" shape, and is then placed into the internal space in the case 110 of the air cleaner 100.

FIGS. 5A to 5D are perspective views illustrating the filter assembly of the air cleaner according to the embodiment of the present disclosure, in which some of the components of the filter assembly are assembled with each other. FIG. 5E is a perspective view illustrating the filter assembly of the air cleaner according to the embodiment of the present disclosure, which is completely assembled.

According to the embodiment of the present disclosure, the filter assembly 120 includes a filter frame 121 having an outlet portion 125 at one side of the filter assembly 120, a filter member 128 coupled to the filter frame 121 so as to be supported thereby, and a first cover 129 and a second cover 131, which are respectively disposed above and under the filter member 128 and are integrally secured to the upper portion and the lower portion of the filter frame 121.

The filter member 128 serves to remove foreign substances from air when the air passes therethrough. The filter member may be made of non-woven fabric, and may be configured to have an approximate "U" shape overall.

According to the embodiment of the present disclosure, the internal space defined in the "U"-shaped filter member 128 is the second clean-side space S2, through which the air having passed through the filter member 128, that is, the air filtered through the filter member 128, flows.

The filter assembly 120 includes the outlet portion 125 provided at one side of the filter assembly 120. The outlet portion 125 may be integrally formed with the filter frame 121, as described above.

According to the embodiment of the present disclosure, when the filter member 128 is coupled to the filter frame 121, the path in the outlet portion 125 communicates with the internal space in the filter member 128, that is, the second space S2 in the filter assembly 120.

The outlet portion 125 of the filter assembly 120 is configured to have a cylindrical shape, and is coupled to the outlet port 112 in the case 110. The outlet portion 125 is a path portion connecting the second clean-side space S2 in the filter assembly 120 to the inner path in the outlet port 112.

According to the embodiment of the present disclosure, the filter frame 121 of the filter assembly 120 may include a first filter frame 121*a*, coupled to the inner portion of the filter member 128, and a second filter frame 121*b*, coupled to the outer portion of the filter member 128.

The filter member 128 is disposed between the first filter frame 121*a* and the second filter frame 121*b*. When the filter frame 121 is assembled with the filter member 128, the first filter frame 121*a* is positioned in the filter member 128, and the second filter frame 121*b* is positioned outside the filter member 128.

Figure 5A:
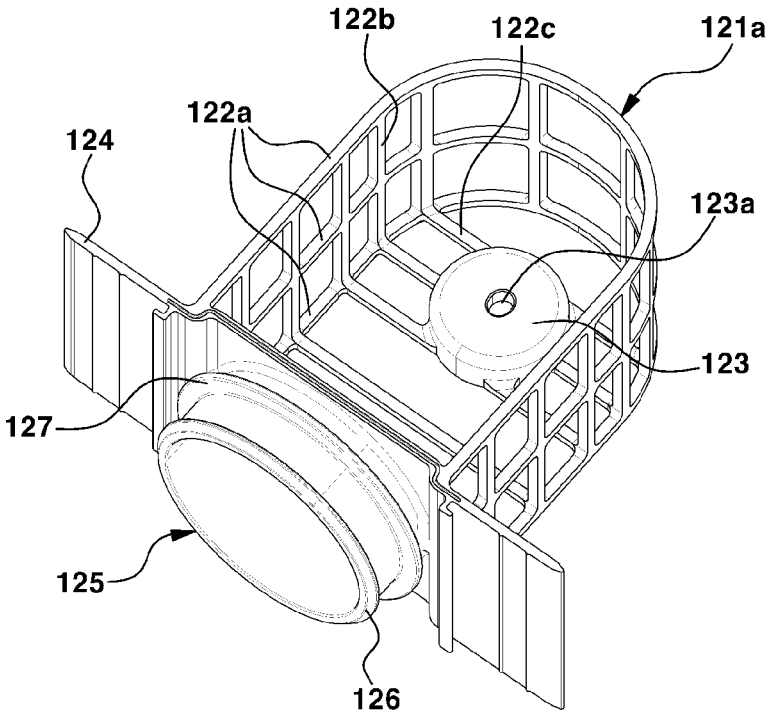
FIGS. 5A to 5D are perspective views illustrating the filter assembly of the air cleaner according to the embodiment of the present disclosure, in which some of the components of the filter assembly are assembled with each other.
Figure 5B:
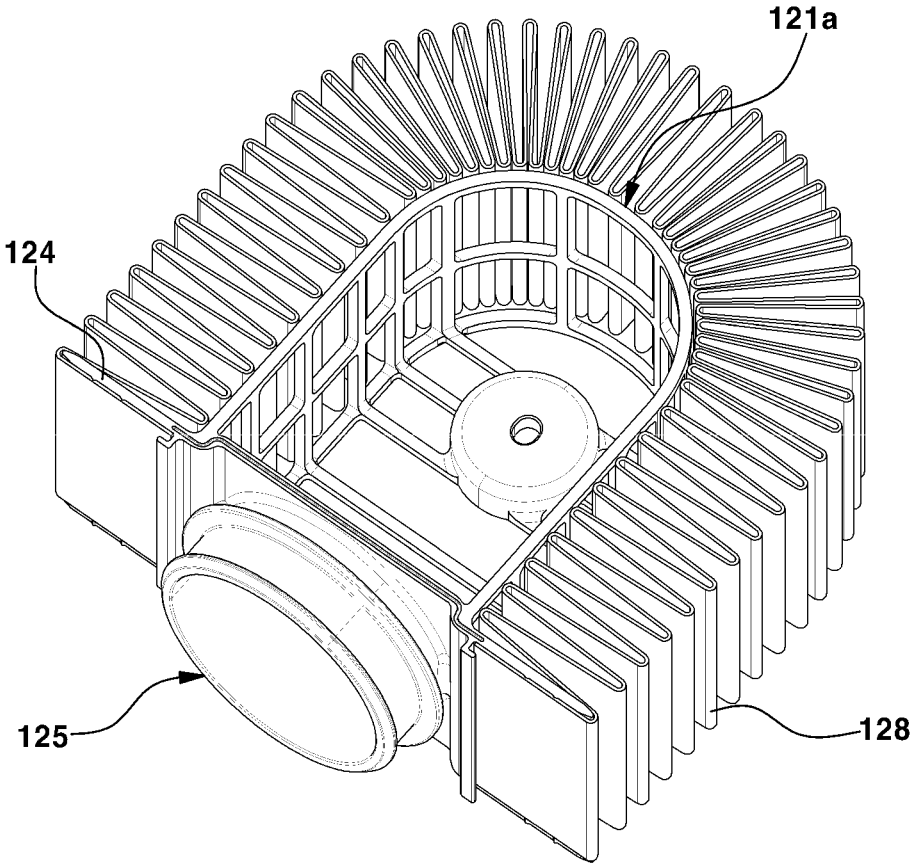
Figure 5C:
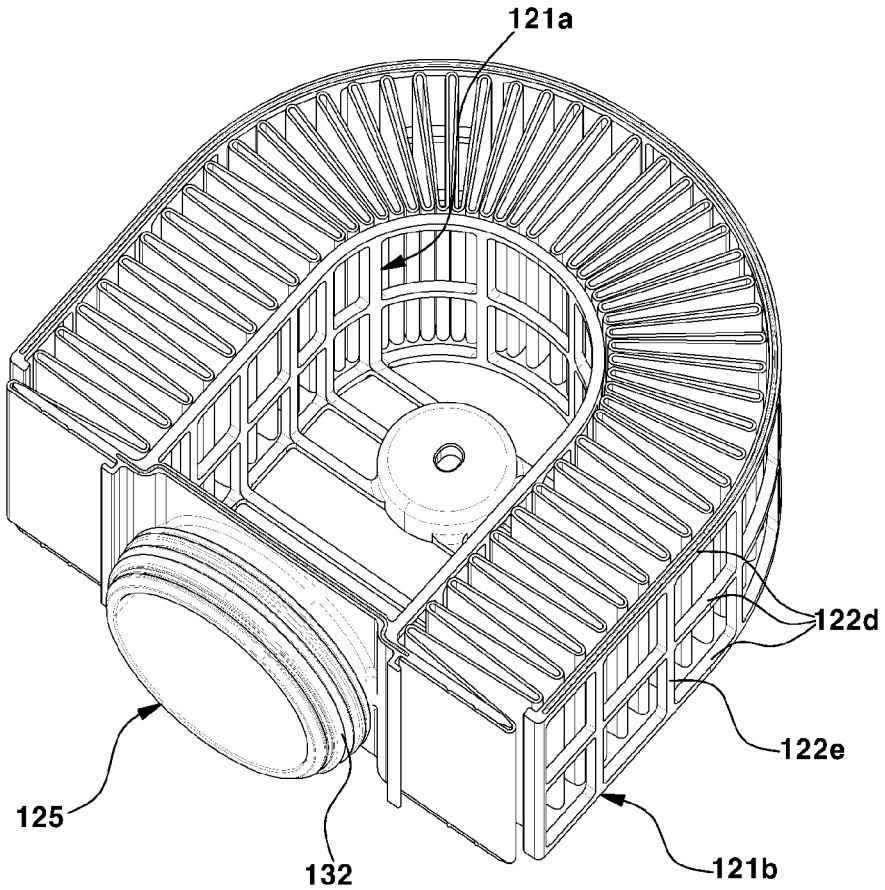
Figure 5D:
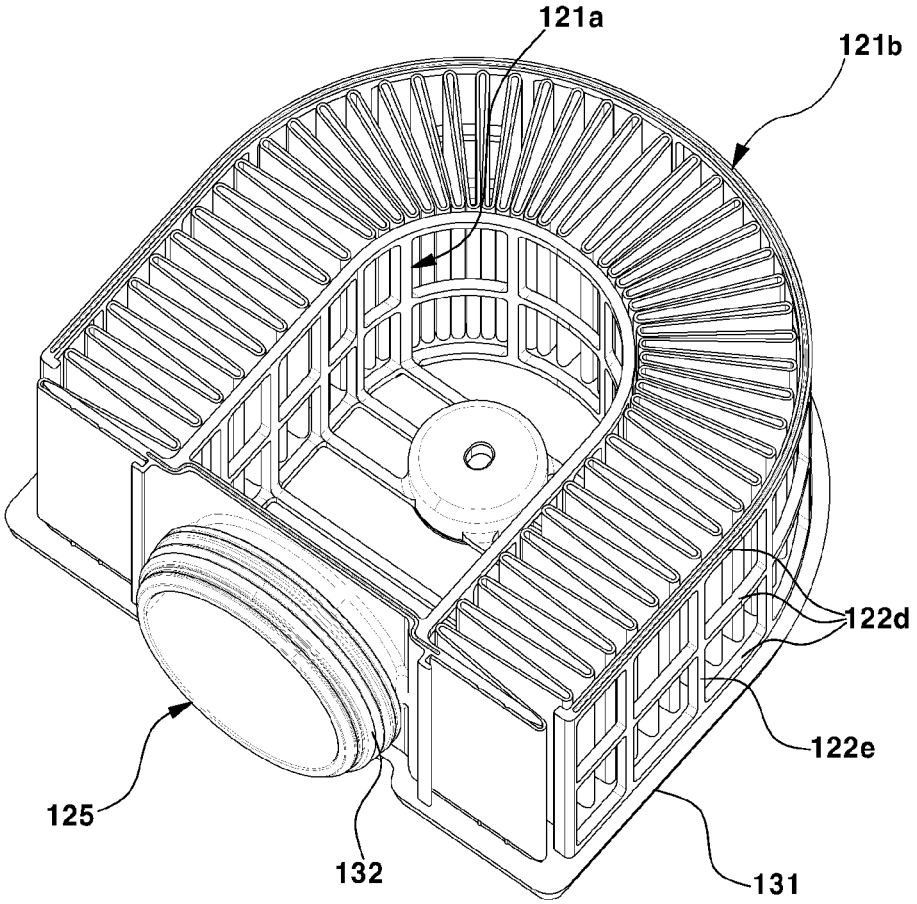
Figure 5E:
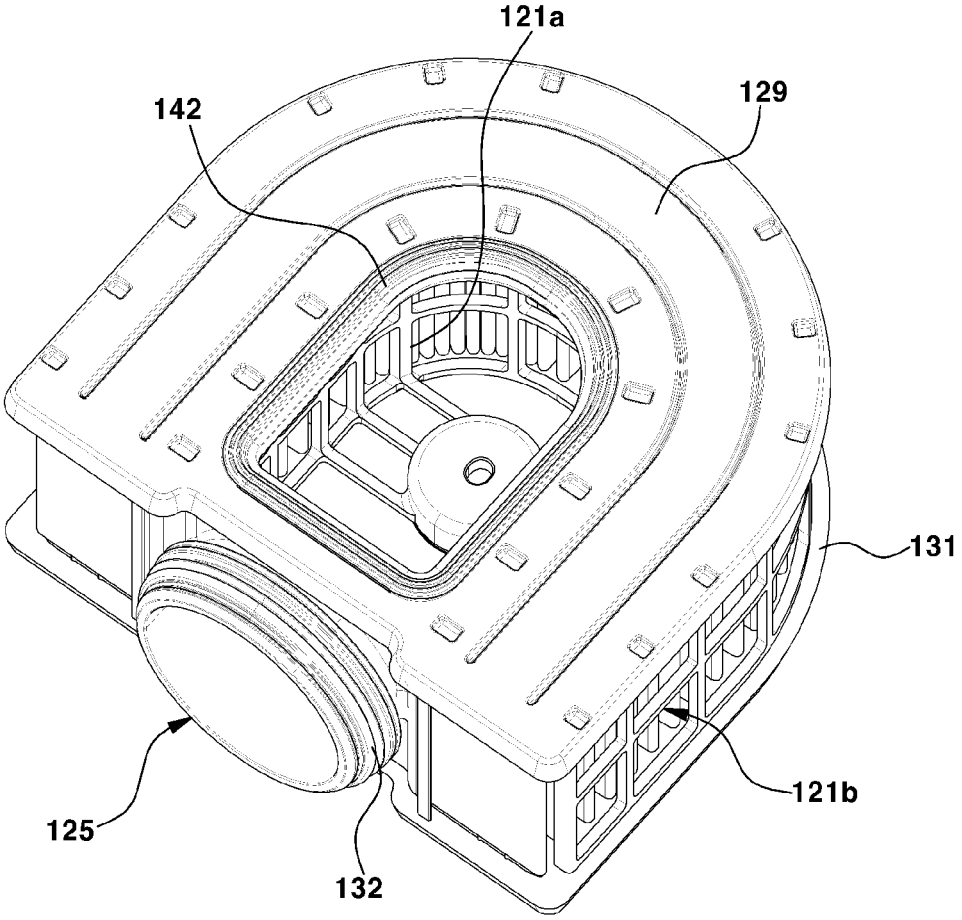
FIG. 5E is a perspective view illustrating the filter assembly of the air cleaner according to the embodiment of the present disclosure, which is completely assembled.

FIGS. 5A to 5E sequentially illustrate a process of assembling the filter assembly 120. FIG. 5A illustrates the first filter frame 121*a*, and FIG. 5B illustrates the state in which the "U"-shaped filter member 128 is coupled to the outer portion of the first filter frame 121*a*.

FIG. 5C illustrates the state in which a first seal ring 132 is coupled to the outlet portion 125 and the second filter frame 121*b* is assembled with the outer portion of the filter member 128. FIG. 5D illustrates the state in which the second cover 131, which is the lower cover of the filter assembly 121*a*, is integrally secured through fusion to the lower portion of the filter frame 121, that is, both the lower portion of the first filter frame 121*a* and the lower portion of the second filter frame 121*b*.

FIG. 5E illustrates the state in which a second seal ring 142 is coupled in a trap-mounting hole (130 in FIGS. 8 and 9) and the first cover 129, which is the upper cover of the filter assembly 120, is integrally secured through fusion to the upper portion of the filter frame 121, that is, both the upper portion of the first filter frame 121*a* and the upper portion of the second filter frame 121*b*.

The first filter frame 121*a* of the filter frame 121 may be constructed such that a plurality of rod-shaped members are disposed so as to intersect each other and are integrally coupled to each other.

In particular, the first filter frame 121*a* may include a plurality of first rod-shaped members 122*a*, each of which is configured to have a "U" shape overall and which are arranged parallel to each other in a vertical direction, second rod-shaped members 122*b*, which extend vertically so as to connect the first rod-shaped members 122*a*, which are arranged parallel to each other in a vertical direction, to each other, and third rod-shaped members 122*c*, which are disposed at the bottom of the second space S2, that is, the internal space in the filter member 128, and are connected to both sides of the lowermost one of the first rod-shaped members 122*a*, each of which has a "U" shape.

According to the embodiment of the present disclosure, the second filter frame 121*b* may also be configured such that a plurality of rod-shaped members are disposed so as to intersect each other and are integrally coupled to each other, like the first filter frame 121*a*.

As illustrated in FIG. 5C, the second filter frame 121*b* may include a plurality of fourth rod-shaped members 122*d*, each of which is configured to have a "U" shape overall and which are arranged parallel to each other in a vertical direction, and fifth rod-shaped members 122*e*, which extend vertically so as to connect the fourth rod-shaped members 122*d*, which are arranged parallel to each other in a vertical direction, to each other.

The first filter frame 121*a* is provided at one side of the first filter frame 121*a* with a support plate 124, configured to support the filter member 128.

The support plate 124 may be integrally secured to the individual ends of the first rod-shaped members 122*a*, each of which is configured to have a "U" shape. The support plate 124 may connect opposite ends of each of the first rod-shaped members 122*a* to each other.

The support plate 124 supports are coupled to the individual ends of the filter member 128 so as to maintain the "U" shape of the filter member 128 and support the opposite ends of the filter member 128 at the first filter frame 121*a*.

According to the embodiment of the present disclosure, the outlet port 125 is secured to the support plate 124 of the filter assembly 120. Here, the path in the outlet portion 125 communicates with the internal space in the filter assembly 120, as described above.

Figure 6:
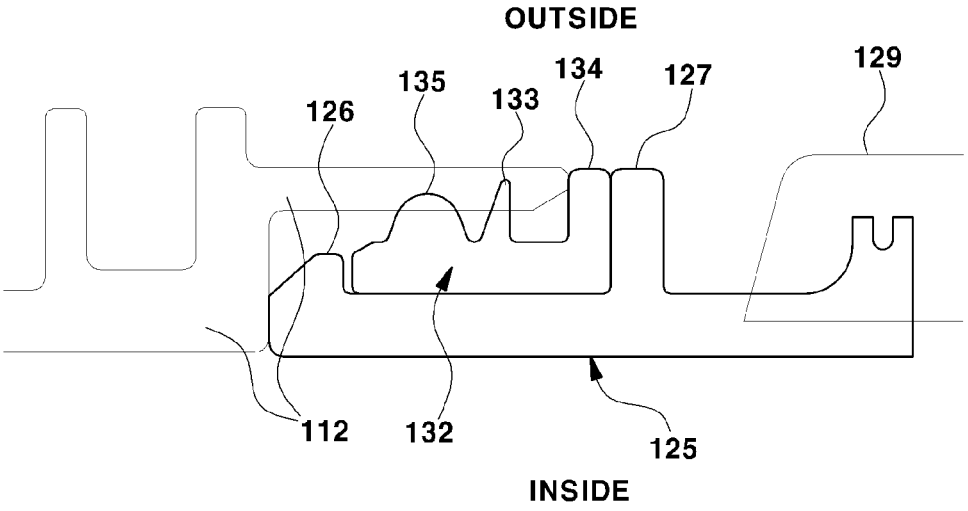
FIG. 6 is a cross-sectional view of the air cleaner according to the embodiment of the present disclosure, taken along line A-A in FIG. 3, which illustrates the coupling structure between an outlet port of a case and an outlet portion of the filter assembly.

FIG. 6 is a cross-sectional view of the air cleaner 100 according to the embodiment of the present disclosure, taken along line A-A in FIG. 3, which illustrates the coupling structure between the outlet port 112 of the case 110 and the outlet portion 125 of the filter assembly 120.

Each of the outlet port 112 and the outlet portion 125 may have a circular section. As illustrated in FIG. 6, the outlet portion 125, which is positioned at an inner side, may be fitted into the outlet port 112, which is positioned at an outer side.

As illustrated in FIG. 6, the outlet portion 125 of the filter assembly 120 may be fitted into the outlet port 112 formed in the case 110 and may be coupled thereto.

Preferably, the first seal ring 132 may be interposed between the outlet port 112 in the case 110 and the outlet portion 125 of the filter assembly 120, which is fitted into the outlet port 112. As illustrated in FIG. 6, the first seal ring 132 may be interposed and pressed between the inner surface of the outlet port 112 and the outer surface of the outlet portion 125.

The first seal ring 132 may be manufactured by molding an elastic material such as rubber.

As illustrated in FIG. 6, the end of the outlet portion 125 of the filter assembly 120 may be provided on an outer circumferential surface of the outlet portion 125 with a first protrusion 126, which is bent outwards in the radial direction.

The first protrusion 126 is configured to have a shape, which projects radially outwards from the outlet portion 125 of the filter assembly 120 and which continuously extends in the circumferential direction on the outer surface of the outlet portion 125 of the filter assembly 120.

As illustrated in FIG. 6, the outlet portion 125 of the filter assembly 120 may also be provided on the outer circumferential surface of the outlet portion 125 with a second protrusion 127, which is positioned behind the first protrusion 126 with a predetermined distance therebetween. The second protrusion 127 may also project radially outwards.

The second protrusion 127 may also be configured to have a shape that continuously extends in the circumferential direction on the outer surface of the outlet portion 125 of the filter assembly 120.

In the outlet portion 125 of the filter assembly 120, which is constructed as described above, the first seal ring 132 is fitted in the space between the first protrusion 126 and the second protrusion 127 on the outer circumferential surface of the outlet portion 125 of the filter assembly 120.

When the filter assembly 120 is mounted in the internal space in the case 110, the outlet portion 125 of the filter assembly 120 is fitted into the outlet port 112 in the case 110 in the state in which the first seal ring 132, which is an O-ring, is fitted into the outlet port 112 in the case 110.

As illustrated in FIG. 6, when the outlet portion 125 is completely fitted into the outlet port 112, the first seal ring 132, which is fitted on the outer circumferential surface of the outlet portion 125 between the first protrusion 126 and the second protrusion 127, is pressed between the outer circumferential surface of the outlet portion 125 and the inner circumferential surface of the outlet port 112 in the case 110.

The first seal ring 132 may have a multiple sealing structure in cross-section, in which multiple portions of the first seal ring 132 are concurrently in close contact with the inner circumferential surface of the outlet port 112 when the first seal ring 132 is fitted and pressed between the outer circumferential surface of the outlet portion 125 and the inner circumferential surface of the outlet port 112 in the case 110.

Figure 7:
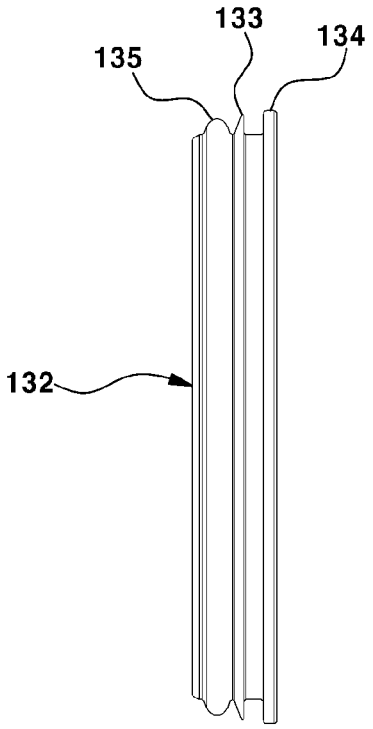
FIG. 7 is a view illustrating a first annular seal ring of the air cleaner according to the embodiment of the present disclosure, which is interposed between the outlet port of the case and the outlet portion of the filter assembly.

FIG. 7 is a view illustrating the first annular seal ring 132 of the air cleaner 100 according to the embodiment of the present disclosure, which is interposed between the outlet port 112 in the case 110 and the outlet portion 125 of the filter assembly 120.

As illustrated in FIG. 7, an outer circumferential surface of the first seal ring 132 is provided with a lip 133, which projects outwards so as to be in close contact with the inner circumferential surface of the outlet port 112 and which continuously extends in the circumferential direction on the outer circumferential surface of the first seal ring 132.

The outer circumferential surface of the first seal ring 132 is also provided with a pressing portion 134, which projects outwards so as to be pressed between the end of the outlet port 112 and the second protrusion 127 of the outlet portion 125. The pressing portion 134 also extends continuously in the circumferential direction on the outer circumferential surface of the first seal ring 132.

Furthermore, the outer circumferential surface of the first seal ring 132 is also provided with a contact portion 135, which is pressed between the outlet port 112 and the outlet portion 125 in the state of being in close contact with the inner circumferential surface of the outlet port 112. The contact portion 135 also extends continuously in the circumferential direction on the outer circumferential surface of the first seal ring 132.

The contact portion 135 may be convex so as to have a semicircular cross-section, unlike the lip 133, which has a smaller thickness. The contact portion 135 and the lip 133 constitute a dual sealing structure, and the contact portion 135, the lip 133 and the pressing portion 134 constitute a triple sealing structure.

As described above, since the first seal ring 132, which is capable of realizing a multiple sealing structure, is interposed and pressed between the outlet port 112 in the case 110 and the outlet portion 125 of the filter assembly 120, it is possible to prevent leakage of air and to maintain sufficient airtightness.

Figure 8:
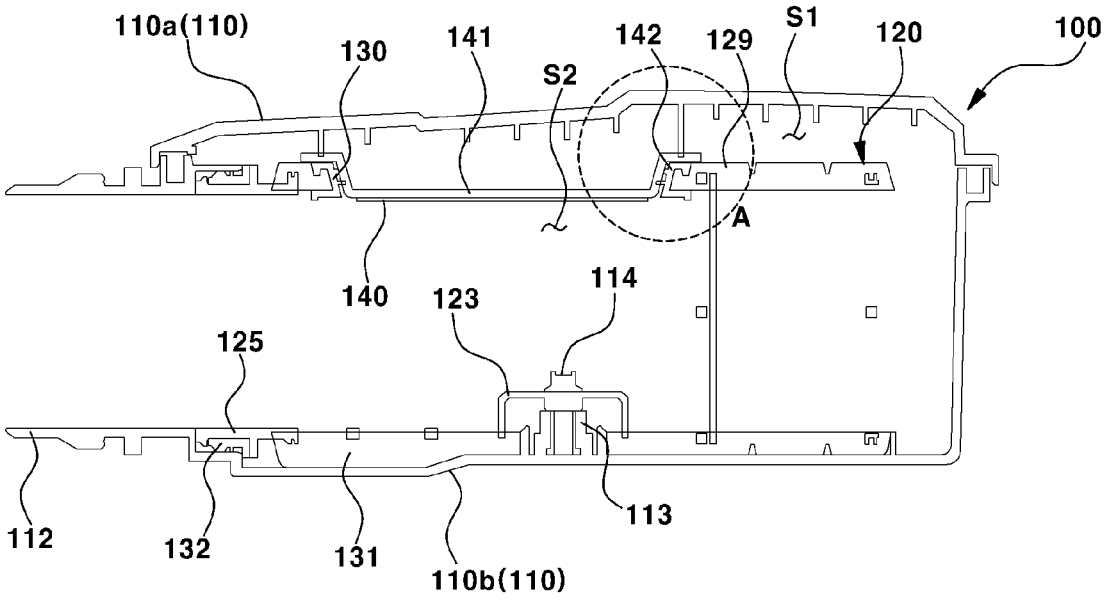
FIGS. 8 and 9 are cross-sectional views illustrating the state in which a hydrocarbon trap is mounted on the horizontal-flow-type air cleaner according to the embodiment of the present disclosure.
Figure 9:
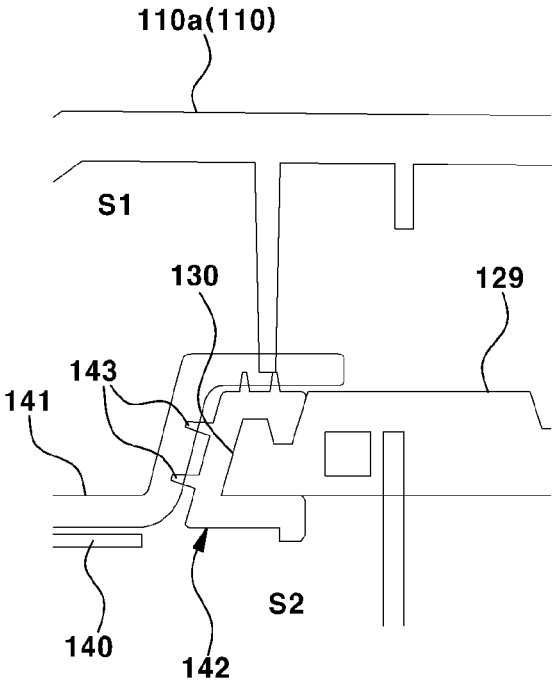

FIGS. 8 and 9 are cross-sectional views illustrating the state in which the hydrocarbon trap 140 is mounted on the horizontal-flow-type air cleaner according to the embodiment of the present disclosure. FIG. 9 is an enlarged view of a portion "A" in FIG. 8.

In the air cleaner 100 according to the embodiment of the present disclosure, the hydrocarbon trap (HC trap) 140 is coupled to the filter assembly 120 in the state of being secured to the first case 110*a*, which is the upper case of the case 110.

According to the embodiment of the present disclosure, the hydrocarbon trap 140 is coupled to the first cover 129, which is the upper cover of the filter assembly 120. To this end, the first cover 129 is provided therethrough with the trap-mounting hole 130, to which the hydrocarbon trap 140 is mounted and coupled so as to be positioned in the second space S2, as illustrated in FIG. 4.

The hydrocarbon trap 140 is securely mounted on a support 141 provided at the first case 110*a* and is coupled to the first cover 129 of the filter assembly 120. Here, the support 141 is integrally secured to the first case 110*a* so as to project downwards from the inner surface of the first case 110*a*, and the hydrocarbon trap 140 is mounted on the lower surface of the support 141.

The support 142 is configured to have a shape and a size such that the support 141 is inserted into the trap-mounting hole 130 formed in the first cover 129 of the filter assembly 120. When the support 141 is fitted into the trap-mounting hole 130 in the first cover 129 in the state in which the hydrocarbon trap 140 is mounted on the lower surface of the support 141, the hydrocarbon trap 140 is exposed to the second space S2, which is the internal space in the filter assembly 120.

The second space S2, which is the internal space in the filter assembly 120, is opened through the trap-mounting hole 130 in the first cover 129. When the filter assembly 120 is received in the internal space in the second case 110*b* and coupled thereto and the first case 110*a* is then coupled to the upper portion of the second case 110*b*, the support 141 of the first case 110*a* is fitted into the trap-mounting hole 130 in the first cover 129 and coupled thereto. At this point, because the lower surface of the support 141 is positioned in the second space S2 in the filter assembly 120, the hydrocarbon trap 140 is also positioned in the second space S2 in the filter assembly 120.

Since the hydrocarbon trap 140 is positioned in the second space S2 of the internal space in the air cleaner 100, through which the clean air flows, it is possible to prevent the air holes in the hydrocarbon trap 140 from being clogged with foreign substances contained in external air, which is not filtered, as in the conventional case. In particular, according to the present disclosure, foreign substances are removed through the filter member 128, and clean air flows through the second space S2.

Because a conventional air cleaner 1 is constructed such that the hydrocarbon trap 4 is mounted on the inner surface of the case 2 outside the filter assembly 3 rather than in the second clean-side space S2 and the external space of the filter assembly 3 is the first dirty-side space S1 through which external air (unfiltered) flows, there is a problem in that the air holes in the hydrocarbon trap 4 become clogged with foreign substances contained in the external air in the first space S1.

Furthermore, because the conventional air cleaner 1 is constructed such that the hydrocarbon trap 4 is mounted to the inner surface of the case 1 in the external space of the filter assembly 3, the distance between the hydrocarbon trap 4 and the outlet port 5, which is the hose connector, is increased, as can be appreciated from FIG. 1.

In contrast, according to the embodiment of the present disclosure, since the hydrocarbon trap 140 is positioned and mounted in the second space S2, which is the internal space in the filter assembly 120, in the state of being coupled to the first cover 129, which is the upper cover of the filter assembly 120, it is possible to decrease the distance between the hydrocarbon trap 140 and the air hose connector, that is, the distance between the hydrocarbon trap 140 and the outlet port 112 or the outlet portion 125, compared to a conventional air cleaner 100.

Particularly, according to the embodiment of the present disclosure, the hydrocarbon trap 140 is positioned at a lower level than a conventional hydrocarbon trap 4.

Because hydrocarbon gas, which is discharged from the cylinder of the engine while the engine is stopped, is heavier than air, the hydrocarbon gas introduced into the internal space in the air cleaner 100 through the outlet port 112, mainly flows to a lower level in the internal space in the air cleaner 100.

When the hydrocarbon trap 140 is positioned closer to the outlet port 112 and the filter assembly 120 than in the conventional case and the hydrocarbon trap 140 is positioned at a lower level than in the conventional case, it is possible to improve the ability to collect hydrocarbons and to more efficiently and effectively collect hydrocarbons through the hydrocarbon trap 140.

Furthermore, even through the capability and efficiency of the hydrocarbon trap 140 in the collection of hydrocarbons are improved, it is possible to reduce the size of the hydrocarbon trap 140, and it is in turn possible to reduce manufacturing costs by virtue of the reduction in size of the hydrocarbon trap 140.

In addition, since the hydrocarbon trap 140 is positioned in the internal space in the filter assembly 120, that is, the second clean-side space in the air cleaner 100, through which the filtered air flows, it is possible to prevent the air holes in the hydrocarbon trap 140 from being clogged with foreign substances contained in the air.

As illustrated in FIGS. 5A to 5E and FIG. 8, the third rod-shaped members 122*c*, which constitute the first filter frame 121*a* of the filter frame 121 of the filter assembly 120, are provided with a coupler 123, which projects upwards.

The bottom of the second case 110*b*, which is the lower case of the case 110 of the air cleaner 100, is provided at a location corresponding to the coupler 123, for example, at the center location of the filter assembly 120, with a mount portion 113, which projects upwards so as to enable the coupler 123 of the filter assembly 120 to be fastened thereto.

The mount portion 113 of the case 110 of the air cleaner 100 is a portion to which the filter assembly 120 is fastened and mounted. According to the embodiment of the present disclosure, after the coupler 123 of the filter assembly 120 is placed on the mount portion 113 of the case 110, the coupler 123 may be integrally fastened to the mount portion 113 by a bolt 114, which is a fastening element.

To this end, the coupler 123 is provided therethrough with a through hole 123*a* (FIG. 5A) through which the bolt 114 passes, and the mount portion 113 is provided therein with a fastening hole with which the bolt 114 is threaded. Accordingly, by threading the bolt 114 with the fastening hole in the mount portion 113 through the through hole 123*a* in the coupler 123, it is possible to integrally couple the coupler 123 to the mount portion 113, and thus it is possible to integrally fasten and secure the filter assembly 120 in the case 110.

Referring to FIGS. 8 and 9, the second seal ring 142 may be interposed and pressed between the trap-mounting hole 130 formed in the first cover 129 of the filter assembly 120 and the support 141 of the first case 110*a* fitted in the trap-mounting hole 130, for airtightness therebetween.

According to the embodiment of the present disclosure, there is a need to assuredly maintain an airtight seal between the support 141 of the first case 110*a* and the trap-mounting hole 130 in the first cover 129. To this end, since the second seal ring 142 is interposed between an outer circumferential surface of the support 141 and the inner circumferential surface of the trap-mounting hole 130, it is possible to seal the gap between the support 141 and the trap-mounting hole 130, and it is possible to reliably prevent leakage of air through the gap between the first space S1, which is the external space of the filter assembly 120, and the second space S2, which is the internal space of the filter assembly 120.

According to the embodiment of the present disclosure, the second seal ring 142 may be interposed and pressed between the entire outer circumferential surface of the support 141 and the entire inner circumferential surface of the trap-mounting hole 130. To this end, the second seal ring 142 is fitted in advance into the entire inner circumferential surface of the trap-mounting hole 130 in the first cover 129, and the support 141 is brought into close contact with the inner surface of the second seal ring 142 at the time of assembly of the first case 110*a*.

Consequently, when the first case 110*a* is securely coupled to the second case 110*b*, the second seal ring 142 is pressed between the outer circumferential surface of the support 141 and the inner circumferential surface of the trap-mounting hole 130, thereby ensuring the seal between the support 141 and the trap-mounting hole 130. At this time, the hydrocarbon trap 140 attached to the lower surface of the support 142 is positioned in the second space S2, which is the internal space of the filter assembly 120.

According to the embodiment of the present disclosure, the inner circumferential surface of the second seal ring 142, which comes into contact with the outer circumferential surface of the support 141, may be provided with one or more lips 143, as illustrated in FIG. 9. Here, each of the lips 143 may be configured to project and continuously extend along the entire inner circumferential surface of the second seal ring 142.

As is apparent from the above description, because the air cleaner 100 according to the embodiment of the present disclosure is provided with the hydrocarbon trap 140, which is positioned close to the hose connector, it is possible to further improve the capability of the hydrocarbon trap 140 to collect hydrocarbons and to efficiently and effectively collect hydrocarbons through the hydrocarbon trap 140, compared to a conventional air cleaner.

The disclosure has been described in detail with reference to preferred embodiments thereof. However, it will be appreciated by those skilled in the art that changes may be made in these embodiments without departing from the principles and spirit of the disclosure, the scope of which is defined in the appended claims and their equivalents.

What is claimed is:

1. A vehicle air cleaner, comprising:

a case including an inlet port, through which external air is introduced, and an outlet port, through which filtered air is discharged;

a filter assembly provided in a first space of an internal space in the case to filter the external air introduced through the inlet port and to remove foreign substances from the external air, wherein the filter assembly includes, a filter frame including an outlet portion through which the filtered air flows, the portion being a path portion connecting a second space of the internal space in the case to the outlet port in the case;

a filter member coupled to the filter frame and supported thereby to remove foreign substances from the external air while allowing the external air introduced into the first flow therethrough; and first and second covers, which are respectively disposed above and under the filter and a hydrocarbon trap provided in the second space of the internal space in the case, through which the air filtered through the filter assembly flows, to collect hydrocarbons in the second space.

2. The vehicle air cleaner of claim 1, wherein the filter frame includes:

a first filter frame coupled to an inner portion of the filter member; and a second filter frame coupled to an outer portion of the filter member.

3. The vehicle air cleaner of claim 2, wherein each of the first and second filter frames is composed of a plurality of rod-shaped members, which are disposed to intersect each other and are integrally coupled to each other.

4. The vehicle air cleaner of claim 1, wherein the filter member is disposed in the internal space in the case to have a "U" shape, and wherein a space outside the "U"-shaped filter member is the first space, which communicates with the inlet port in the case, and a space inside the "U"-shaped filter member is the second space, which communicates with the outlet port in the case.

5. The vehicle air cleaner of claim 4, wherein the filter frame includes:

a first filter frame coupled to an inner portion of the filter member; and a second filter frame coupled to an outer portion of the filter member, and wherein each of the first and second filter frames is composed of a plurality of rod-shaped members, which are disposed to intersect each other and are integrally coupled to each other.

6. The vehicle air cleaner of claim 5, wherein the first filter frame includes:

a plurality of first rod-shaped members, each of which is configured to have a "U" shape and which are arranged parallel to each other in a vertical direction;

a second rod-shaped member, which is coupled to the first rod-shaped members arranged parallel to each other so as connect the first rod-shaped members to each other; and a third rod-shaped member, which is disposed at a bottom of the second space, which is the space inside the filter member, and which is coupled to both sides of a lowermost one of the first rod-shaped members, having the "U" shape, to connect the both sides of the first rod-shaped member to each other.

7. The vehicle air cleaner of claim 6, wherein the third rod-shaped member includes a coupler, which is integrally fastened to a mount portion formed at the case by a fastening element.

8. The vehicle air cleaner of claim 6, wherein a first support plate is coupled to first ends of the first rod-shaped members and a second support plate is coupled to second ends of the first rod-shaped members, the first and second support plates being respectively coupled to two ends of the filter member to support the two ends of the filter member and thus to maintain the "U" shape of the filter member.

9. The vehicle air cleaner of claim 5, wherein the second filter frame includes:

a plurality of fourth rod-shaped members, each of which is configured to have a "U" shape and which are arranged parallel to each other in a vertical direction; and a fifth rod-shaped member coupled to the fourth rod-shaped members arranged parallel to each other, to connect the fourth rod-shaped members to each other.

10. The vehicle air cleaner of claim 1, wherein the outlet portion of the filter assembly is fitted into the outlet port in the case and coupled thereto, and a first seal ring is interposed and pressed between the outlet portion of the filter assembly and the outlet port in the case.

11. The vehicle air cleaner of claim 10, wherein the first seal ring, which is coupled to an outer circumferential surface of the outlet portion of the filter assembly, is pressed in a multiple sealing structure in which a plurality of portions of the first seal ring are in contact with an inner circumferential surface in the case in cross-section.

12. The vehicle air cleaner of claim 11, wherein the first seal ring includes a convex contact portion and a lip projecting from an outer circumferential surface of the first seal ring, each of the contact portion and the lip being pressed by the inner circumferential surface in the outlet port in the case and continuously extending in a circumferential direction.

13. The vehicle air cleaner of claim 11, wherein the outlet portion of the filter assembly includes a first protrusion formed at one side on the outer circumferential surface of the outlet portion of the filter assembly and a second protrusion formed on another side on the outer circumferential surface of the outlet portion of the filter assembly, and wherein the first seal ring is coupled to the outer circumferential surface of the outlet portion between the first protrusion and the second protrusion.

14. The vehicle air cleaner of claim 13, wherein the first seal ring includes a pressing portion projecting from an outer circumferential surface of the first seal ring, the pressing portion being interposed and pressed between an end of the outlet port and the second protrusion of the outlet portion and continuously extending in a circumferential direction.

15. The vehicle air cleaner of claim 1, wherein the first cover has a trap-mounting hole formed in the second space, and the case includes a support provided on an inner surface of the case, the support being fitted into the trap-mounting hole, and wherein the hydrocarbon trap is securely mounted on the support to be exposed to the second space in the filter assembly.

16. The vehicle air cleaner of claim 15, wherein a second seal ring is interposed and pressed between an outer circumferential surface of the support fitted in the trap-mounting hole and an inner circumferential surface of the trap-mounting hole.

* * * * *